US006290462B1

(12) United States Patent
Ishiguro et al.

(10) Patent No.: US 6,290,462 B1
(45) Date of Patent: Sep. 18, 2001

(54) GAS TURBINE COOLED BLADE

(75) Inventors: Tatsuo Ishiguro; Koji Watanabe; Masaaki Matsuura; Kenichiro Takeishi; Junichiro Masada; Yasuoki Tomita; Kiyoshi Suenaga, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/272,559

(22) Filed: Mar. 19, 1999

(30) Foreign Application Priority Data

Mar. 26, 1998 (JP) ..... 10-079181
Mar. 26, 1998 (JP) ..... 10-079184

(51) Int. Cl.[7] ..... F01D 11/00; F01D 5/18
(52) U.S. Cl. ..... 416/97 R
(58) Field of Search ..... 416/97 R, 96 R, 416/232, 233; 415/115

(56) References Cited

U.S. PATENT DOCUMENTS 3,533,711 * 10/1970 Kercher ..... 416/96 R X
3,628,880 * 12/1971 Smuland et al. ..... 416/97 R X
3,844,678 * 10/1974 Sterman et al. ..... 416/97 R
4,514,144 * 4/1985 Lee ..... 416/96 R
5,395,212 * 3/1995 Anzai et al. ..... 416/97 R
5,472,316 * 12/1995 Taslim et al. ..... 416/97 R
5,681,144 * 10/1997 Spring et al. ..... 416/97 R
5,688,104 * 11/1997 Beabout ..... 416/97 R X
5,695,321 * 12/1997 Kercher ..... 416/97 R
5,738,493 * 4/1998 Lee et al. ..... 416/97 R
5,741,117 * 4/1998 Clevenger et al. ..... 416/97 R X
5,797,726 * 8/1998 Lee ..... 416/96 R
5,813,836 * 9/1998 Starkweather ..... 416/97 R
5,827,043 * 10/1998 Fukuda et al. ..... 416/97 R X
5,857,837 * 1/1999 Zelesky et al. ..... 416/97 R
5,902,093 * 5/1999 Liotta et al. ..... 416/97 R
5,919,031 * 7/1999 Hall et al. ..... 416/96 R
5,967,752 * 10/1999 Lee at al. ..... 416/97 R
5,975,850 * 11/1999 Abuaf et al. ..... 416/97 R
5,975,851 * 11/1999 Liang ..... 416/97 R

FOREIGN PATENT DOCUMENTS

876540 * 7/1971 (CA) ..... 415/115
1601561 * 10/1978 (DE) ..... 415/115
7-293203 11/1995 (JP) .

* cited by examiner

*Primary Examiner*—John E. Ryznic
(74) *Attorney, Agent, or Firm*—Wenderoth, Lind & Ponack, L.L.P.

(57) ABSTRACT

A gas turbine cooled blade is constructed without an increase in the number of parts or time requirements, in which seal air is maintained at a lower temperature with the heat exchange rate being suppressed, and the heat transfer rate of the cooling medium in cooling passage is enhanced. A plurality of cooling passages (A, B, C, D, E) is provided in a blade, and the first row cooling passage (A) is covered at the blade inner and outer peripheries and communicates with the second row cooling passage (B) through communication holes (6) and with the main flow gas path through film cooling holes (7). The second row cooling passage (B) communicates with the blade inner peripheral cavity (10) to form a seal air supply passage. A plurality of ribs (31) are disposed on the inner wall of cooling passage (22) with a predetermined pitch (P). The ribs are arranged alternately and are inclined against cooling medium flow with respective higher first end contacting lower side faces of an immediately upstream rib at a position on both side portions of cooling passage (22). High heat transfer rate areas are formed on both side portions of cooling passage (22), and the average heat transfer rate in cooling passage is enhanced.

8 Claims, 12 Drawing Sheets

31
22
23
Main flow direction
θ
θ
P
Wa width
rib
Wentire width
e height
f 23b
27
Main flow direction 23
27

23
27
Main flow direction 26
26

28
24
22
θ
c
M
h
e
p
Main flow direction

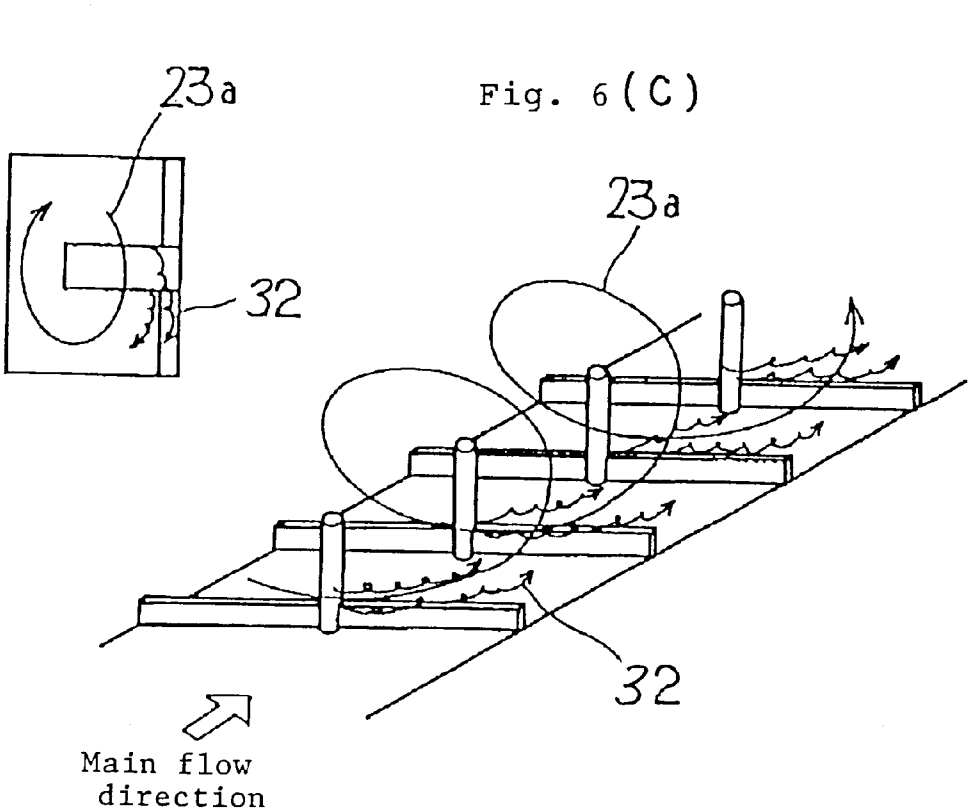
Fig. 6(b)
Fig. 6(c)
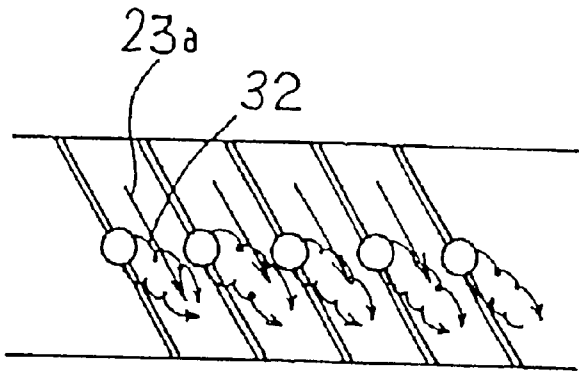
Fig. 6(d)
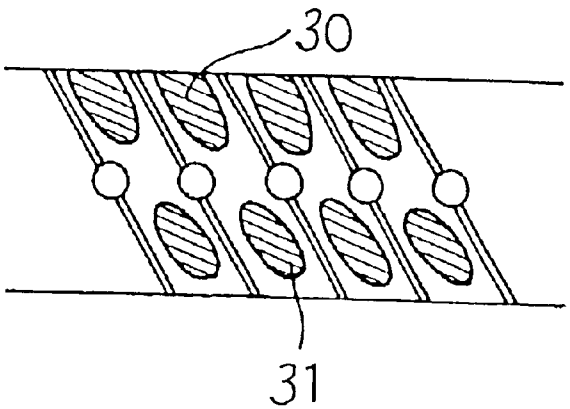
Fig. 6(d)

23a
22

23a
24

23a
22

30
22

GAS TURBINE COOLED BLADE

BACKGROUND OF THE INVENTION

1. Field of the Invention

The present invention relates generally to a gas turbine cooled blade and more specifically to a gas turbine cooled blade having a seal air supply passage for supplying therethrough a seal air from an outer peripheral side to an inner peripheral side of a stationary blade. The present invention also relates to a gas turbine cooled blade having a structure for enhancing a heat transfer rate in a cooling passage of a moving blade or a stationary blade.

2. Description of the Prior Art

Examples of the above-mentioned type gas turbine cooled stationary blade in the prior art will be described with reference to FIGS. 7 and 8.

FIG. 7 is a schematic cross sectional view of one example of a prior art gas turbine cooled blade, wherein FIG. 7(*a*) is a longitudinal cross sectional view and FIG. 7(*b*) is a cross sectional view taken on line III–III of FIG. 7(*a*). FIG. 8 is a schematic cross sectional view of another example of a prior art gas turbine cooled blade, wherein FIG. 8(*a*) is a longitudinal cross sectional view and FIG. 8(*b*) is a cross sectional view taken on line IV–IV of FIG. 8(*a*).

In an actual unit of the gas turbine, the number of stages is decided by the capacity of the turbines. For example, in a gas turbine constructed in four stages, its second, third and fourth stage stationary blades, respectively, have moving blades disposed in front and back thereof and each of the stationary blades is structured to be surrounded by adjacent moving blades and rotor discs supporting them. Hence, it is important that a main flow high temperature gas does not flow into a gap of each portion in an interior of the stationary blade, in which the gap is formed there during manufacture, assembly, etc.

As a countermeasure therefor, a construction is usually employed so that a bleed air from a compressor flows into the interior of the stationary blade from its outer peripheral side to be supplied into a cavity portion on an inner peripheral side of the stationary blade as a seal air. Thus, a pressure in the cavity portion is kept higher than that in a main flow high temperature gas path, thereby preventing inflow of the main flow high temperature gas.

The prior art example of FIG. 7 is of a seal air supply structure using a seal tube 4 for leading therethrough a seal air. The seal tube 4 is provided in a stationary blade at a position apart from an inner surface of a blade portion 5 to pass through a first row cooling passage A of a leading edge portion in the blade portion 5. Thus, a blade outer peripheral side communicates with a-cavity portion of a blade inner peripheral side so that a seal air 3 is supplied into the cavity portion through the seal tube 4.

Numeral 2 designates a cooling medium, which is supplied for cooling of the stationary blade to flow through the first row cooling passage A and further through a second row cooling passage B and a third row cooling passage C in the blade portion 5. The cooling medium is then discharged into the main flow high temperature gas from a blade trailing edge portion.

Also, another example in the prior art shown in FIG. 8 is constructed such that a sealing air 3 is supplied directly into a first row cooling passage A to be used both for a sealing air and a blade cooling air, wherein a seal tube such as used in the example of FIG. 7 is not used.

In the moving blade and stationary blade of a conventional gas turbine including those blades shown in FIGS. 7 and 8, there are provided cooling passages so that cooling medium is led to pass therethrough for cooling of the interior of the blade. By such cooling, gas turbine portions to be exposed to the main flow high temperature gas flowing outside thereof are cooled so that the strength of these gas turbine portions is maintained so as not to be deteriorated by the high temperature.

FIG. 9 is a longitudinal cross sectional view of the conventional gas turbine cooled blade. In FIG. 9, numeral 21 designates a-cooled blade (moving- blade), in which a cooling passage 22 is provided passing therethrough. Numeral 23 designates a cooling medium, which flows into the blade from a base portion of the cooled blade 21 to flow through cooling passages 22*a*, 22*b* and 22*c* sequentially and is discharged into a gas path where a high temperature gas 25 flows. A plurality of ribs 24 are arranged inclinedly on inner walls of the cooling passages 22*a*, 22*b*, 22*c*, as described later, so that the cooling medium 23 flows in each of the cooling passages as shown by arrow 29 with a heat transfer rate therein being enhanced.

FIG. 10 is an enlarged view of one of the cooling passages of the cooled blade 21 in the prior art as described above, wherein FIG. 10(*a*) is a plan view thereof and FIG. 10(*b*) is a perspective view thereof. As shown there, in the cooling passage 22 of the cooled blade 21, the plurality of ribs 24 are provided, each extending in an entire width W of the cooling passage 22 to be disposed at an incline with a constant angle 0 relative to a flow direction of the cooling medium 23 with a rib to rib pitch P and projecting a height e. The cooling medium 23 is led into the cooling passage 22 from outside of the cooled blade 21 to flow through the cooled blade 21 for sequential cooling therein and is discharged into the high temperature gas 25, as described in FIG. 9. At this time, the rib 24 causes turbulences in the flow of the cooling medium 23 so that the heat transfer-rate of the cooling medium 23 flowing through the cooling passage 22 is enhanced.

FIG. 11 is a schematic explanatory view of a flow pattern and a cooling function thereof of the cooling medium 23 flowing in the cooling passage 22 of FIG. 10, wherein FIG. 11(*a*) shows a flow direction of the cooling medium 23 seen on a plan view of the cooling passage 22, FIG. 11(*b*) shows a flow of the cooling medium 23 seen from one side of FIG. 11(*a*), FIG. 11 (*c*) shows the flow of the cooling medium 23 seen perspectively and FIG. 11(*d*) shows a heat transfer rate distribution in the cooling passage 22.

As shown there, in a space between each of the ribs 24, the cooling medium 23 becomes a swirl flow 23*a* as in FIG. 11(*a*) to flow downstream from upstream there so as to move in a constant direction along the rib 24 inclined as in FIG. 11(*c*). For this reason, as shown conceptually by the heat transfer rate distribution of FIG. 11(*d*), there is generated a high heat transfer rate area 30 on an upstream side thereof where the swirl flow 23*a* approaches a wall surface of the cooling passage 22 (boundary layer there is thin) . On the other hand, on a downstream side thereof where the swirl flow 23*a* leaves the wall surface of the cooling passage 22 (boundary layer there is thick), the heat transfer rate tends to lower as compared with the upstream side. As a result, there occurs a non-uniformity of the heat transfer rate according to the place, which results in suppressing enhancement of an average heat transfer rate as a whole.

In the first prior art example shown in FIG. 7, there is provided the seal tube 4 which is disposed at the position apart from the inner surface of the blade portion 5 for exclusively leading therethrough the seal air 3. Hence, in this system, while there is an advantage that the seal air 3, making no direct contact with the inner surface of the blade portion 5, can be supplied as the seal air before it is heated by heat exchange, there is also a disadvantage of inviting an increased number of parts and increased time in providing the seal tube 4.

Also, in the second prior art example shown in FIG. 8, while no such seal tube as the seal tube 4 is used and reduction of the parts and time can be realized, the seal air 3 is supplied passing through the blade leading edge portion where there is a large thermal load. Hence, there is needed a large heat exchange rate for cooling of the blade, which results in a problem that a temperature of the seal air becomes too high.

Further, in the prior art gas turbine cooled blade shown in FIGS. 9 to 11, the cooling medium flows to generate the swirl flow 23*a* which flows along the rib 24 in the cooling passage 22 as shown in FIG. 11(*a*). There are formed the high heat transfer rate area 30 in the place where the swirl flows 23*a* approaches the wall surface of the cooling passage 22, and the area of lower heat transfer rate in the place where the swirl flow 23*a* leaves the wall surface of the cooling passage 22 as shown in FIG. 11(*d*). Hence, the heat transfer rate becomes non-uniform to cause a lowering of the average heat transfer rate.

SUMMARY OF THE INVENTION

In order to solve the problems in the prior art as mentioned above, it is an object of the present invention to provide a gas turbine cooled blade in which a seal air is maintained at a lower temperature with its heat exchange rate being suppressed and is led into the blade for a seal air supply with no increase in the number of parts and time required.

It is another object of the present invention to provide a gas turbine cooled blade in which a cooling passage is made in such a structure that shapes of ribs and arrangement thereof are devised so that a high heat transfer rate area caused by a flow of cooling medium in the cooling passage is formed uniformly in a space between each of the ribs to thereby enhance an average heat transfer rate in the entire cooling passage.

In order to achieve this object, the present invention first provides a gas turbine cooled blade having therein a plurality of cooling passages extending in a turbine radial direction. A portion of the plurality of cooling passages is used as a seal air supply passage as well as for supplying therethrough a seal air into a cavity on a blade inner peripheral side from a blade outer peripheral side. A cooling passage of a first row at an upstream position is covered both at its blade inner peripheral side and blade outer peripheral side and communicates with a cooling passage of a second row through a communication hole bored in a partition wall between the cooling passage of the first row and the cooling passage of second row. The cooling passage of te first row also communicates with a main flow gas path through a film cooling hole bored in a blade wall passing therethrough to a blade outer surface. The cooling passage of the second row communicates with the cavity on the blade inner peripheral side so as to form the seal air supply passage.

That is, according to the present invention, the seal air supplied from the blade outer peripheral side flows through the selected second row cooling passage where there is a smaller thermal load and smaller heat exchange rate of the seal air. Thus, an appropriate temperature for the seal air can be maintained.

Also, a portion of the seal air in the second row cooling passage is separated so as to flow into the first row cooling passage through the communication hole to be used as a cooling air. This cooling air first cools the blade leading edge portion which surrounds the first row cooling passage and then makes film-cooling of the blade outer surface, passing through the film cooling hole. Thereby, without an increase in the number of parts, such as a seal tube, the seal air which is suitable to be led into the blade inner peripheral side cavity can be secured, and the appropriate cooling of the blade leading edge portion can be done.

The present invention also provides a gas turbine cooled blade mentioned above, in which the seal air supply passage is formed not by the second row cooling passage but by being selected (channeled) from a third (and subsequent) row cooling passages downstream of the second row cooling passage.

That is, according to the present invention, the cooling passage of the seal air supplied from the blade outer peripheral side to the blade inner peripheral side is formed by being selected from the cooling passages downstream of the second row cooling passage. Thus, the heat exchange rate in the blade portion corresponding to that cooling passage is sufficiently small so that the temperature of the seal air can be maintained at a further lower level, and the seal air which is more suitable to be led into the blade inner peripheral side cavity can be obtained.

The present invention further provides a gas turbine cooled blade having therein a cooling passage. The cooling passage has on its inner wall a plurality of ribs disposed so as to cross a -cooling medium flow direction with a predetermined rib to rib pitch. Each of the plurality of ribs extends from a side end of the cooling passage to a position beyond a central portion thereof to be disposed alternately right and left against the cooling medium flow direction and to be inclined in mutually opposing directions. Each rib also makes contact at its first end beyond the central portion of the cooling passage with a side face of another rib immediately upstream thereof.

That is, according to the present invention, each of the ribs is disposed alternately against the cooling medium flow direction and is inclined in mutually opposing directions while making contact with the side face of the immediate upstream rib at the position slightly biased toward the side from the central portion of the cooling passage. Thereby, the swirl flows are generated on both side portions of the cooling passage due to the cooling medium flowing against the alternately disposed and inclined ribs, and the swirl flows flow while swirling in the space formed by the ribs disposed with the predetermined pitch. Thus, the high heat transfer rate areas are formed on both side portions of the cooling passage, and there is no case of the high heat transfer rate area occurring on one side portion only as in the prior art case. As a result, an increased and uniform high heat transfer rate area is formed in the entire cooling passage, and enhancement of the average heat transfer rate is enhanced.

Also, the present invention provides a gas turbine cooled blade as mentioned above, in which each of the plurality of ribs has a shape in which a height thereof reduces gradually from a higher portion at it first end beyond the central portion of the cooling passage toward a lower portion at its second end at the side end of the cooling passage.

That is, according to the present invention, each of the ribs has a height which reduces gradually from its higher first end to the lower second end. The higher end makes contact with the side face of the immediate upstream rib, so that there are generated the small swirl flows along the cooling medium flow at the contact position of the two ribs. These small swirl flows enhance the heat transfer rate further, in addition to the enhancement of the average heat transfer rate by the above-mentioned invention.

The present invention further provides a gas turbine cooled blade having therein a cooling passage. The cooling passage has on its inner wall a plurality of ribs disposed so as to cross a cooling medium flow direction with a predetermined rib to rib pitch. A pin projects substantially perpendicularly at a predetermined position in a longitudinal direction of a rib of all or a portion of the plurality of ribs.

That is, according to the present invention, by the swirl flows generated by the ribs crossing the cooling medium flow, the high heat transfer rate areas are formed. In addition thereto, the pins project so that the swirl flows are further generated on the downstream side of the respective pins so as to flow along the inclined ribs. Thus, the high heat transfer rate areas are formed also in the area where the high heat transfer rate area had been hardly formed in the prior art, which results in forming of an increased and uniform high heat transfer rate area in the entire cooling passage and enhancement of the average heat transfer rate.

Also, the present invention provides a gas turbine cooled blade as mentioned above, in which the pin is provided in plural pieces with a predetermined pin to pin pitch on the rib.

That is, according to the present invention, the pin is provided in plural pieces with the predetermined pitch between the pins on the rib on which the pin is to be provided. Thus, the high heat transfer rate areas which are formed by the swirl flows generated by the pins can be further increased to form a more uniform high heat transfer rate area, and the average heat transfer rate is further enhanced.

The present invention further provides a gas turbine cooled blade as mentioned above, in which pin is provided in the cooling passage so as to connect a dorsal side portion and a ventral side portion of the blade.

That is, according to the present invention, the pin is provided so as to connect the blade dorsal side and the blade ventral side. Therefore, the pin can be used as a reinforcing element in the cooling passage as well, in addition to the effect of the enhancement of the average heat transfer rate by the increased high heat transfer rate area.

BRIEF DESCRIPTION OF THE DRAWINGS

FIG. 6 is a schematic explanatory view of a flow pattern and a heat transfer rate distribution of a cooling medium in the third embodiment of FIG. 5, wherein FIG. 6(*a*) is a plan view of the flow pattern, FIG. 6(*b*) is a side view thereof, FIG. 6(*c*) is a perspective view and FIG. 6(*d*) is a view showing the heat transfer rate distribution.

DETAILED DESCRIPTION OF THE INVENTION

Figure 1:
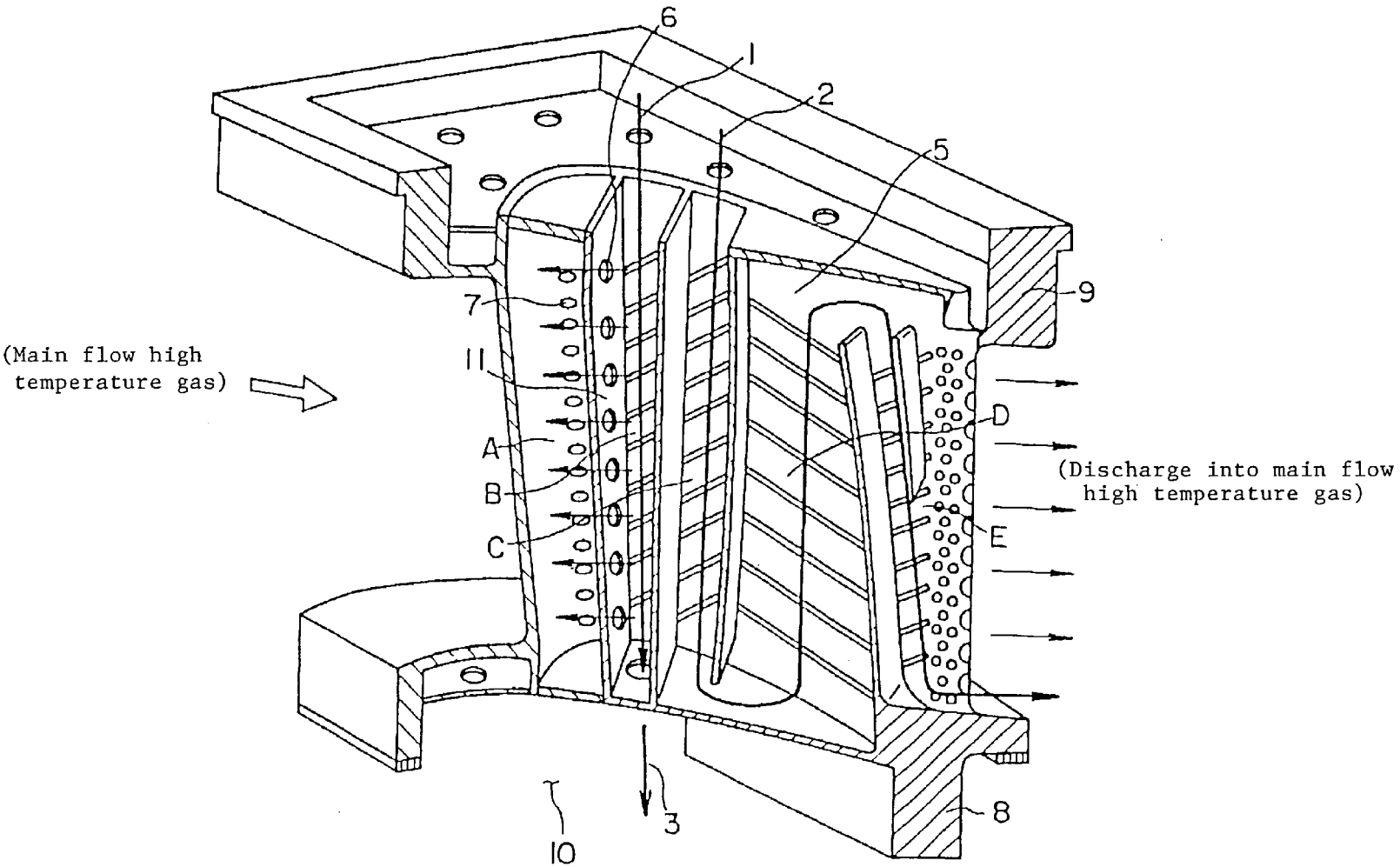
FIG. 1 is a perspective, partially cut away, view of a gas turbine cooled blade of a first embodiment according to the present invention.

A first embodiment according to the present invention will be described with reference to FIGS. 1 and 2. It is to be noted that the same parts as those in the prior art mentioned above are given the same reference numerals in the figures, and repeated description is omitted as much as possible. Characteristic points of the present embodiment will mainly be described.

FIG. 1 is a perspective, partially cut away, view of a gas turbine cooled blade of a first embodiment according to the present invention.

Figure 2B:
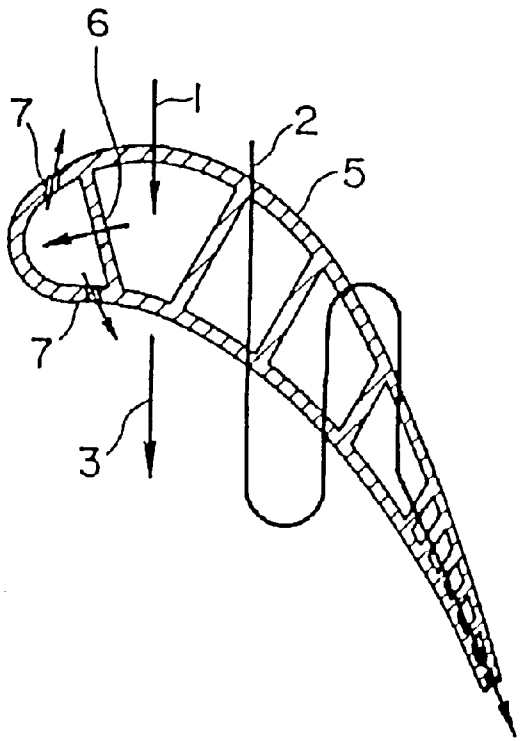
FIG. 2 is a schematic cross sectional view of the gas turbine cooled blade of FIG. 1, wherein FIG. 2(*a*) is a longitudinal cross sectional view and FIG. 2(*b*) is a cross sectional view taken on line II–II of FIG. 2(*a*).
Figure 2A:
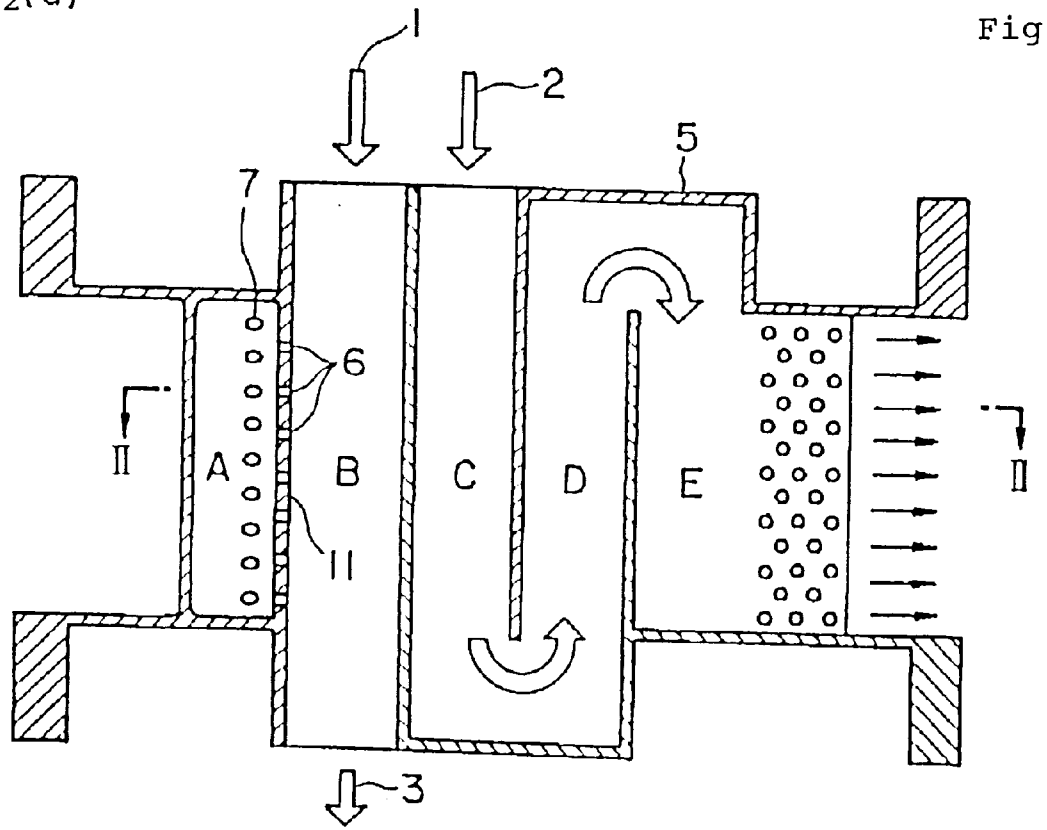

FIG. 2 shows a schematic cross section of the gas turbine cooled blade of FIG. 1, wherein FIG. 2(*a*) is a longitudinal cross sectional view and FIG. 2(*b*) is a cross sectional view taken on line II-II of FIG. 2(*a*).

Figure 8B:
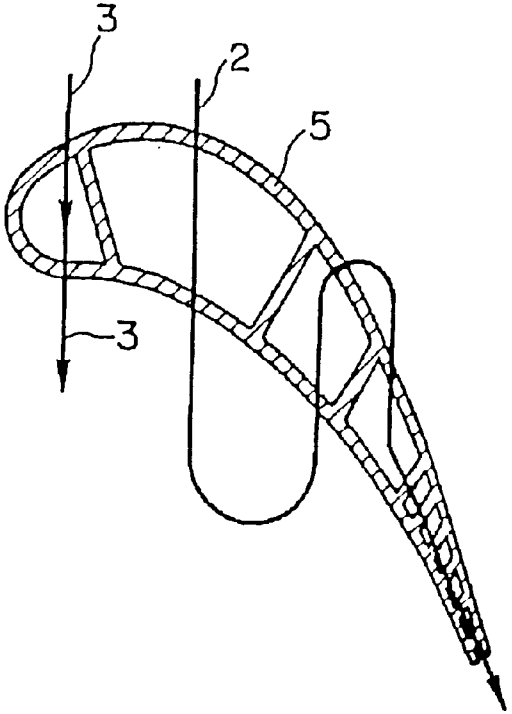
Fig. 8(b) (Prior Art)
FIG. 8 is a schematic cross sectional view of another example of a prior art gas turbine cooled blade, wherein FIG. 8(*a*) is a longitudinal cross sectional view and FIG. 8(*b*) is a cross sectional view taken on line IV-IV of FIG. 8(*a*).
Figure 8A:
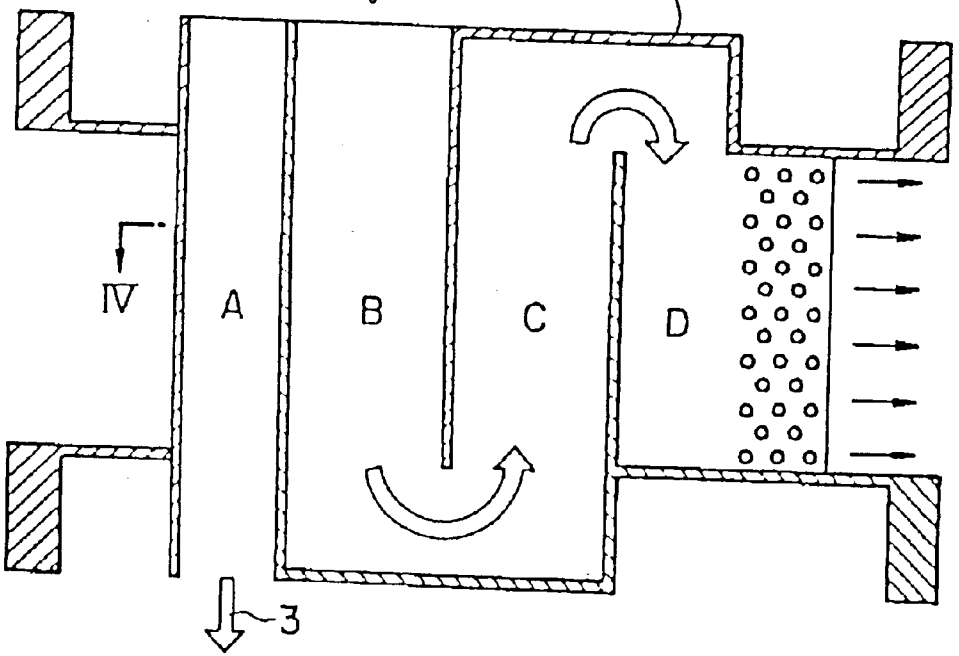
Fig. 8(a) (Prior Art)
Figure 9:
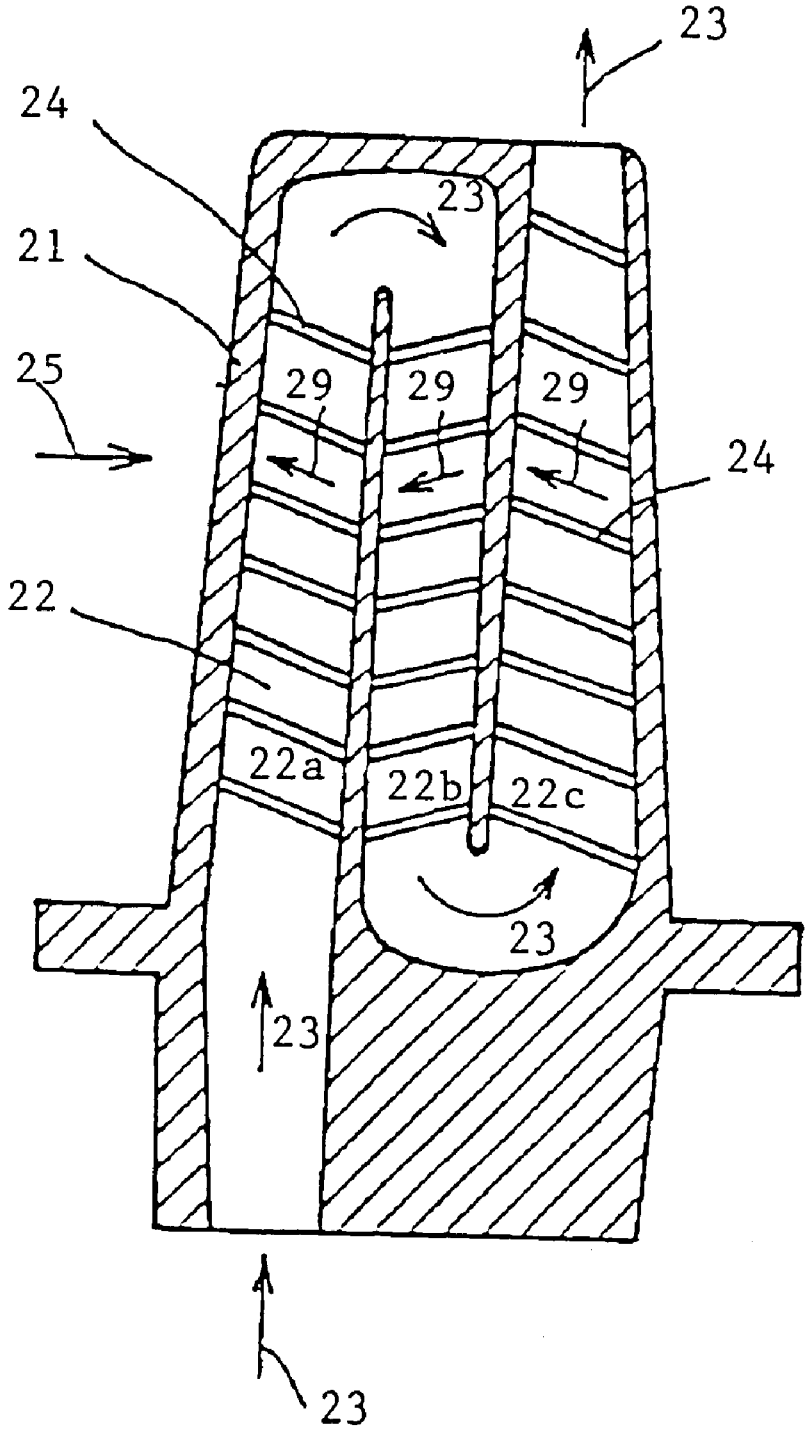
Fig. 9 (Prior Art)
FIG. 9 is a longitudinal cross sectional view of a conventional gas turbine cooled blade.

In the present embodiment, a seal air 3 also having a blade cooling function as well, like in the second example of the prior art of FIG. 8, is not led into a first row cooling passage A provided in a blade leading edge portion, but is led into a second row cooling passage B where there is less thermal load. While the air cools the second row cooling passage B, a portion of the seal air 3 is separated and supplied into the first row cooling passage A, and the portion thereof is led into an inner cavity 10 as the seal air.

That is, as shown in FIGS. 1 and 2, a plurality of communication holes 6 are bored in a cooling passage wall 11 which partitions the first row cooling passage A provided in the blade leading edge portion and the second row cooling passage B. There are also provided a plurality of film cooling holes 7 in walls on a dorsal side and a ventral side, respectively, of a blade portion 5 of the first row cooling passage A.

Further, an inner shroud 8 and an outer shroud 9 of the first row cooling passage A are structured to be closed in a turbine radial direction. Also, third and subsequent row cooling passages (third row cooling passage C, fourth row cooling passage D and fifth row cooling passage E) are structured the same as those in the prior art described above.

In the present embodiment constructed as described above, a cooling medium 1 having both a sealing function and a blade cooling function is supplied into the second row cooling passage B from an outer shroud 9 side. After cooling the inner surfaces of the passage, the cooling medium 1 is partially led into the inner cavity 10 as the seal air 3.

The remaining part of the cooling medium 1 is supplied into the first row cooling passage A through the communication holes 6. After cooling inner surfaces of the passage as a cooling air, the remaining portion is blown into a main flow high temperature gas through the film cooling holes 7 for effecting a film cooling of blade outer surfaces.

Like the cooling air in the prior art, a cooling medium 2 having passed through the third row cooling passage C enters the fourth row cooling passage D formed in a serpentine shape and the fifth row cooling passage E sequentially for cooling of blade inner surfaces. The cooling medium is then blown into the main flow high temperature gas from a blade trailing edge portion.

Thus, according to the present embodiment, the seal air is supplied into the second row cooling passage B where there is less thermal load, and a portion of the cooling air is supplied into the first row cooling passage A through the communication holes 6 of the cooling passage wall 11 for effecting the film cooling of the blade outer surfaces. Thus, the blade outer surfaces of the portion corresponding to the second row cooling passage B are affected by the film cooling and reduced in temperature so that the thermal load of the second row cooling passage B is lowered further, and temperature rise of the seal air in the second row cooling passage B is suppressed further securely. Also, because temperature rise of the seal air supplied into the inner cavity 10 via the second row cooling passage B is suppressed sufficiently, there is no need for using a seal tube, which results in no increase in parts number and assembly time.

It is to be noted that, if a proportion of flow rates of the sealing air to be supplied into the inner cavity 10 from the second row cooling passage B and the cooling air to be supplied into the first row cooling passage A from same is to be regulated, a throttle may be provided at a cooling passage outlet on the inner cavity 10 side.

Figure 12B:
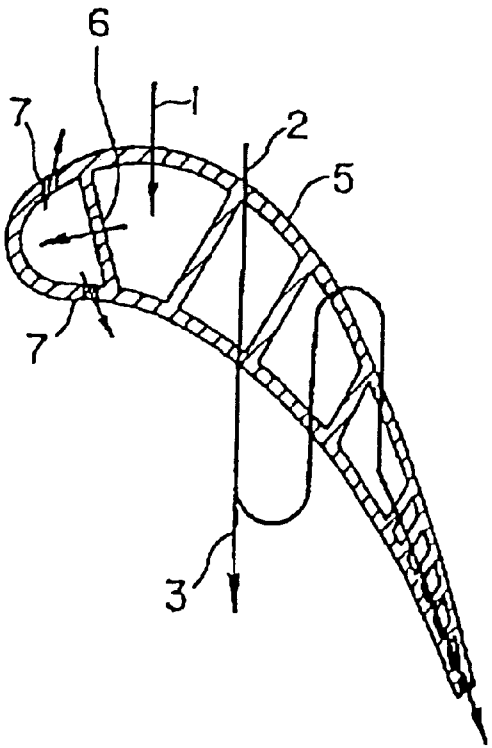
FIG. 12 is a schematic cross-sectional view of an alternate embodiment of the gas turbine cooled blade of FIG. 2, wherein the FIG. 12(*a*) is a longitudinal cross sectional view and FIG. 12(*b*) is a cross sectional view taken along line II—II of FIG. 12(*a*)
Figure 12A:
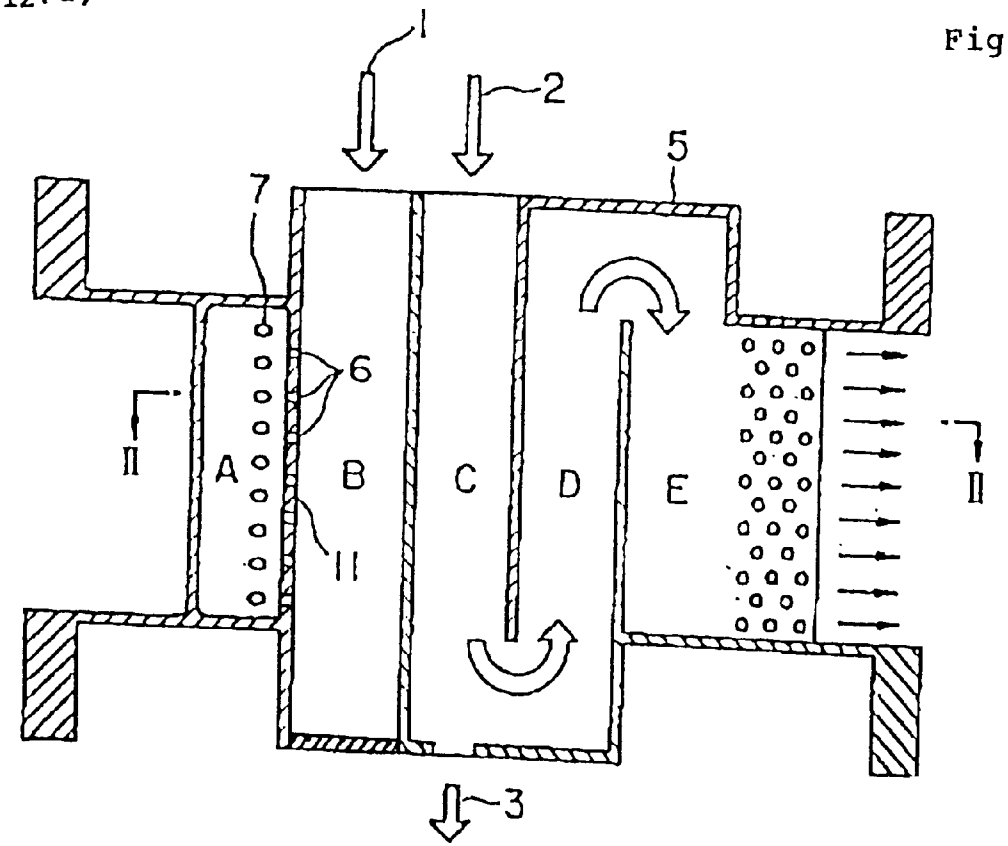

It is also to be noted that, although a description has been done in the present embodiment on the seal air 3 to be supplied into the inner cavity 10 via the second row cooling passage B, the seal air 3 is not limited to that supplied from the second row cooling passage B but may be supplied from the third row cooling passage C or subsequent ones selectively as shown in FIGS. 12(*a*) and 12(*b*).

In the case of such variation as this, the third row cooling passage C and subsequent cooling passages have been less thermal load than the second row cooling passage B. Consequently, the seal air is maintained at a more preferable lower temperature so that the seal air which is suitable for the inner cavity 10 can be secured.

Figure 3:
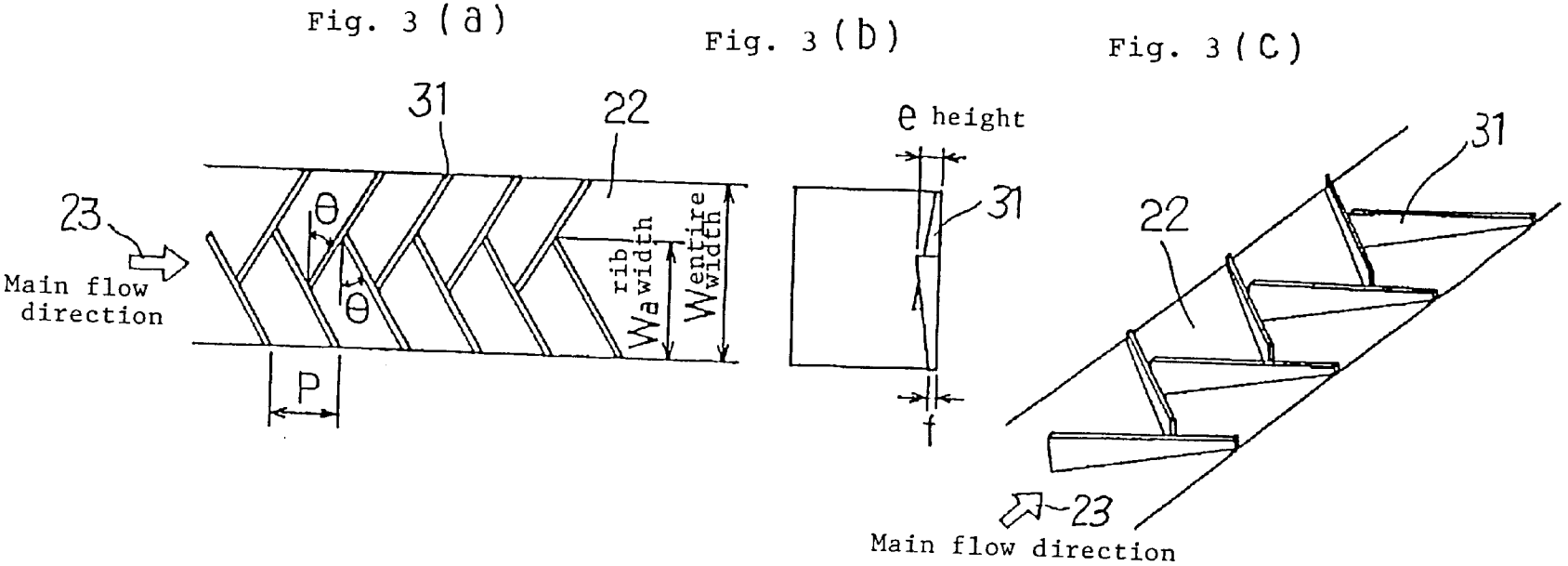
FIG. 3 is a view showing a main part of a cooling passage of a gas turbine cooled blade of a second embodiment according to the present invention, wherein FIG. 3(*a*) is a partially enlarged plan view thereof, FIG. 3(*b*) is a side view thereof and FIG. 3(*c*) is a perspective view thereof.

Next, a second embodiment according to the present invention will be described concretely with reference to FIGS. 3 and 4. FIG. 3 shows a main part of a cooling passage of a gas turbine cooled blade of the second embodiment, wherein FIG. 3(*a*) is a partially enlarged plan view thereof, FIG. 3(*b*) is a side view thereof and FIG. 3(*c*) is a perspective view thereof. In FIG. 3, numeral 31 designates a plurality of ribs, and each of the ribs is disposed on an inner wall surface of a cooling passage 22 extending alternately toward both side directions of a main flow direction of a cooling medium 23. Each of the ribs is also inclined with a constant angle 0 to the main flow direction of the cooling medium 23, and there is a constant rib to rib pitch P in the main flow direction of the cooling medium 23.

As shown in FIG. 3(*a*), each of the ribs 31 is disposed at an incline in a width Wa which is smaller than an entire width W of the cooling passage 22. Each rib has a height that gradually reduces from its higher first end having a height e at a position of the width Wa which is slightly biased to a side end of the cooling passage 22 beyond a central portion thereof toward its lower second end at a downstream outer side thereof having a height f which is lower than e.

Each of the ribs 31 makes contact at its first end portion having the height a with an approximately central portion of a side face of another rib 31 disposed immediately upstream thereof so as to project higher than the side face of the adjacent rib 31 at a contact portion. A plurality of ribs 31 alternatively extend at an incline in mutually opposing directions with the rib to rib pitch P in the main flow direction of the cooling medium 23 in the cooling passage 22.

Figures 4A, 4B, 4C, 4D:
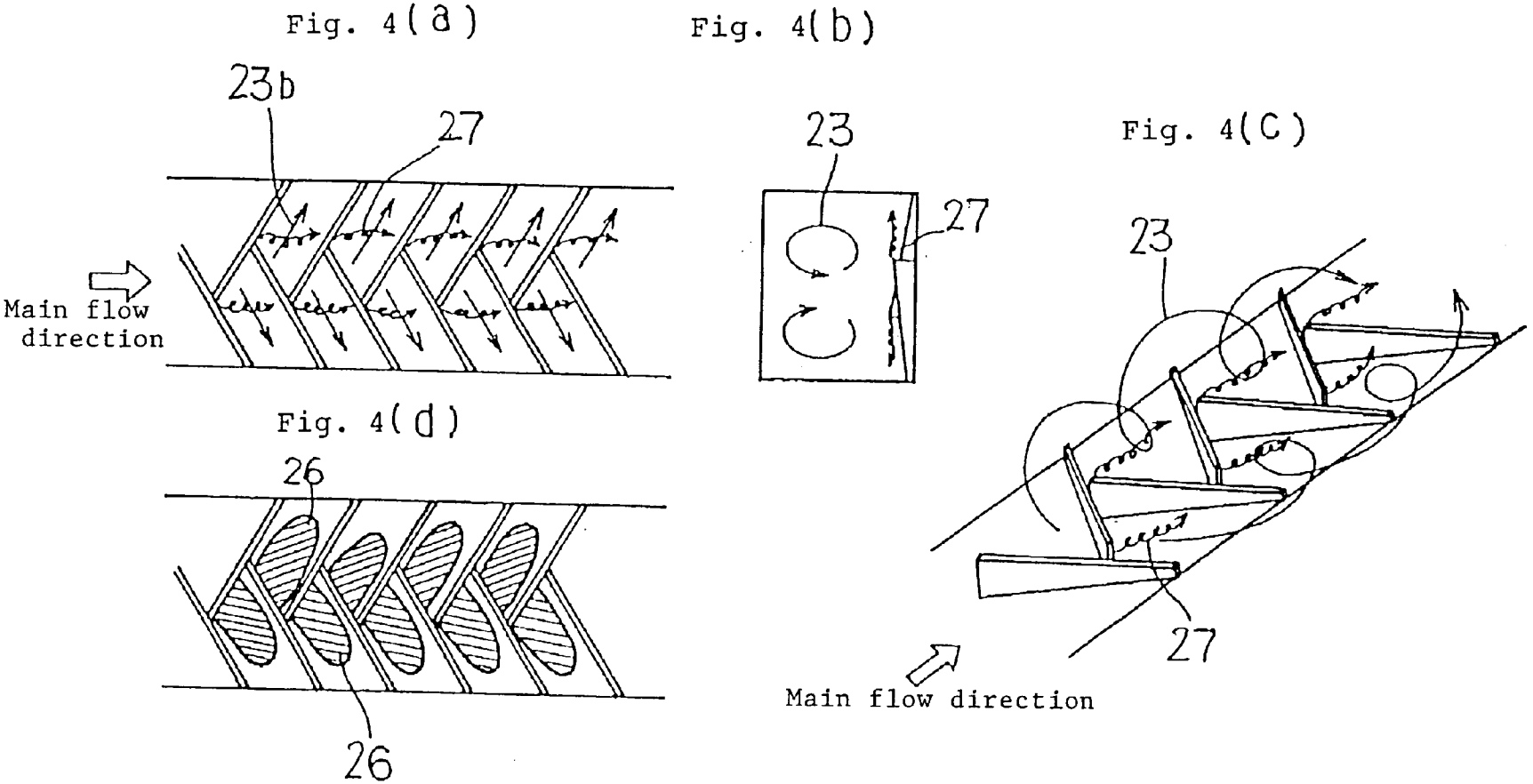
FIG. 4 is a schematic explanatory view of a flow pattern and a heat transfer rate distribution of a cooling medium in the second embodiment of FIG. 3, wherein FIG. 4(*a*) is a plan view of the flow pattern, FIG. 4(*b*) is a side view thereof, FIG. 4(*c*) is a perspective view thereof and FIG. 4(*d*) is s a view showing the heat transfer rate distribution.

FIG. 4 is a schematic explanatory view of a flow pattern and a heat transfer rate distribution of the cooling medium in the second embodiment of FIG. 3, wherein FIG. 4(*a*) is a plan view of the flow pattern, FIG. 4(*b*) is a side view thereof, FIG. 4(*c*) is a perspective view thereof and FIG. 4(*d*) is a view showing the heat transfer rate distribution. As shown there, due to the effect of the ribs 31 disposed alternately and inclined in mutually opposing directions, the cooling medium flowing in the cooling passage 22 generates a swirl flow 23*b* which flows in a swirling motion and is inclined downstream toward a side portion of the cooling passage 22 from the central portion thereof in the respective spaces formed with the pitch P between the ribs 31.

Because the rib 31 has a shape which reduces its height from a to f, and because there occurs a difference in the height at the portion where the ribs 31 make contact with each other, there arises a small swirl flow 27 at a corner portion of the rib 31 having the height e. As the contact portions of the ribs 31 are formed alternately on both side portions of the cooling passage 22, the small swirl flow 27 is also formed on both side portions of the cooling passage.

In the present embodiment constructed as described above, like in the prior art cooling structure, there is formed a high heat transfer rate area 26 on the upstream side of the swirl flow 23*b* as shown in FIG. 4(*d*). Because the swirl flow 23*b* is formed in the respective spaces formed between the ribs 31 on both side portions of the cooling passage 22, the high heat transfer rate area 26 is also formed therein on both side portions of the cooling passage.

Also, the rib 31 has a shape in which the height is reduced from a to f. Hence, the small swirl flow 27 occurring at the corner portion of the rib 31 in the contact portion of the ribs 31 is also generated on both side portions of the cooling passage 22 to assist generation of the high heat transfer rate area 26. As a result, the heat transfer rate is further enhanced.

It is to be noted that, as for the height e, f of the rib 31, even in the case where a equals f, a similar effect can be obtained, and the value e, f may be selected and adjusted so as to obtain a necessary high heat transfer rate.

According to the present embodiment, the ribs 31 are disposed alternately and incline in mutually opposing directions. The first end portion of the rib 31 makes contact with a side surface of the upstream side rib 31, and the rib 31 has a shape to reduce its height from a to f. Thus, the swirl flow 23*b* is generated and the high heat transfer rate area 26 is formed uniformly on both side portions of the cooling passage 22. Moreover, the small swirl 27 is generated at the corner portion of the contact portion of the ribs 31 to assist generation of the high heat transfer rate area 26, which results in enhancing the average heat transfer rate of the entire cooled blade.

Figures 5A, 5B, 5C:
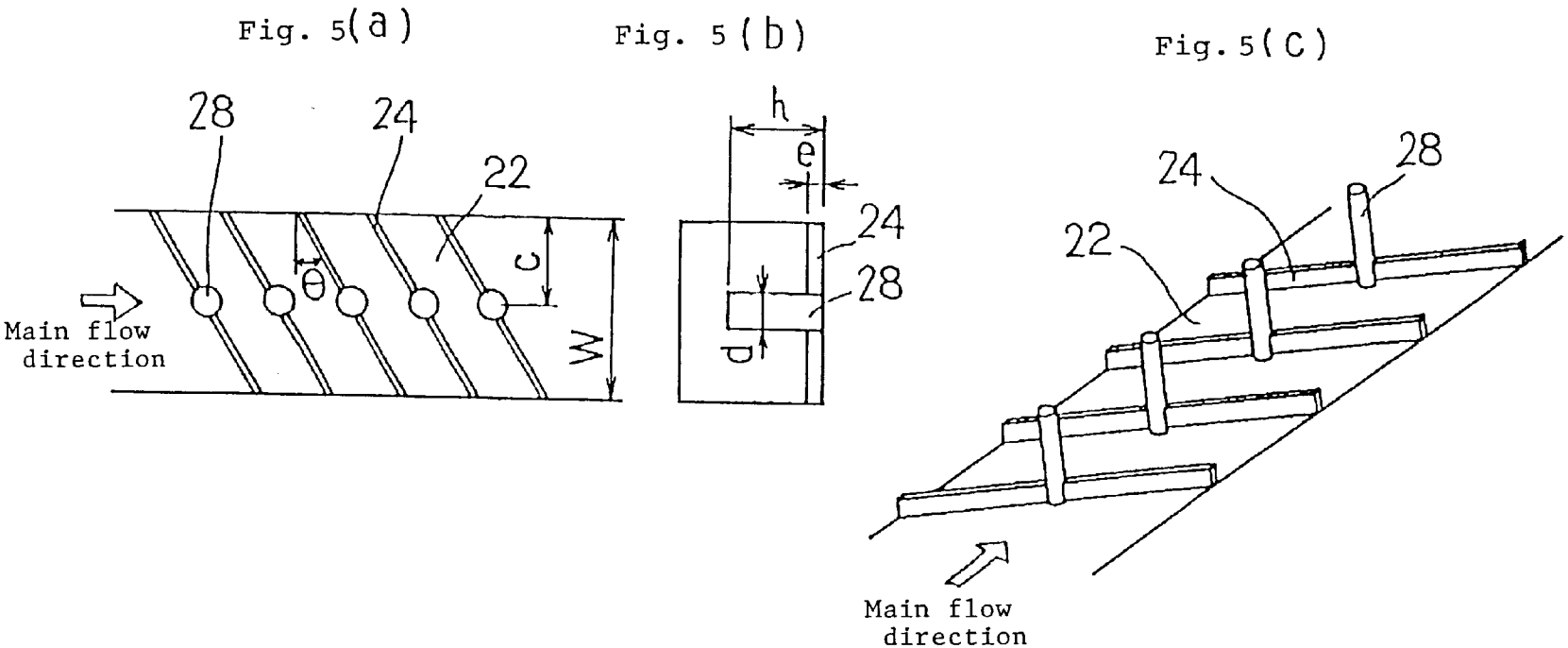
FIG. 5 is a view showing a gas turbine cooled blade of a third embodiment according to the present invention, wherein FIG. 5(*a*) is a partially enlarged plan view, FIG. 5(*b*) is a side view thereof and FIG. 5(*c*) is a perspective view thereof.
Figures 7A, 7B:
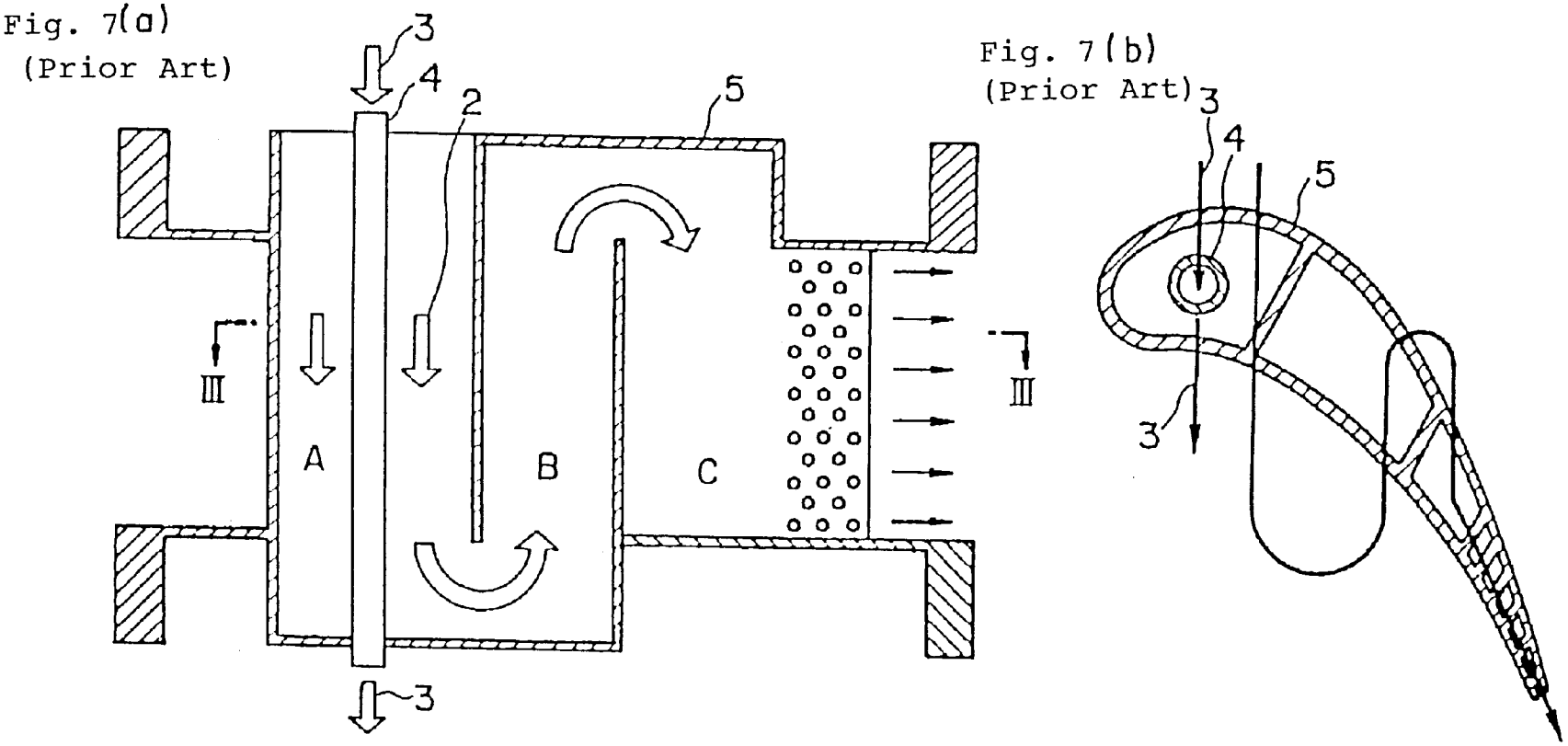
Fig. 7(b) (Prior Art)
Fig. 7(a) (Prior Art)
FIG. 7 is a schematic cross sectional view of one example of a prior art gas turbine cooled blade, wherein FIG. 7(*a*) is a longitudinal cross sectional view and FIG. 7(*b*) is a cross sectional view taken on line III-III of FIG. 7(*a*).
Figure 10B:
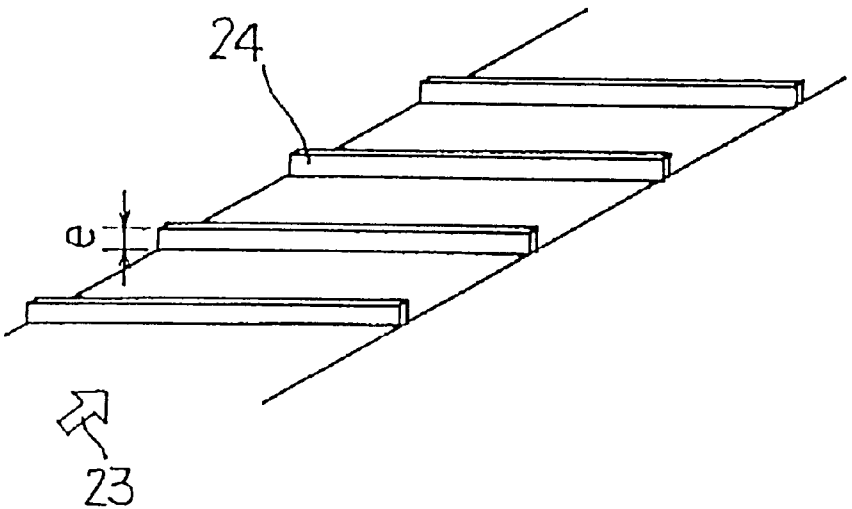
Fig. 10(b) (Prior Art)
FIG. 10 is an enlarged view of one of the cooling passages of the conventional gas turbine cooled blade of FIG. 9, wherein FIG. 10(*a*) is a plan view thereof and FIG. 10(*b*) is a perspective view thereof.
Figure 10A:
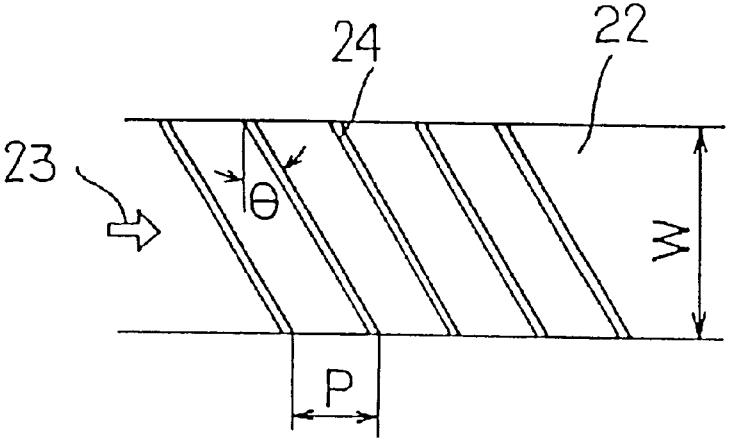
Fig. 10(a) (Prior Art)

FIG. 5 shows a gas turbine cooled blade of a third embodiment according to the present invention, wherein FIG. 5(*a*) is a partially enlarged plan view, FIG. 5(*b*) is a side view thereof and FIG. 5(*c*) is a perspective view thereof. As shown there, the present third embodiment has basically the same shape of rib and the same arrangement thereof as in the prior art, shown in FIG. 10, with an improvement being added to enhance a heat transfer rate in a low heat transfer rate area.

In FIG. 5(*a*), there is provided a pin 28 on the rib 24 an approximately central portion C of an entire width W of the cooling passage 22. The pin 28 has a shape of diameter d and height h, as shown in FIG. 5(*b*) . In the figure, the pin 24 is provided on each of the ribs 24, but the pin 24 is not necessarily provided on each of the ribs 24 and may be provided on every two, three or more ribs 24.

Figures 11A, 11B, 11C, 11D:
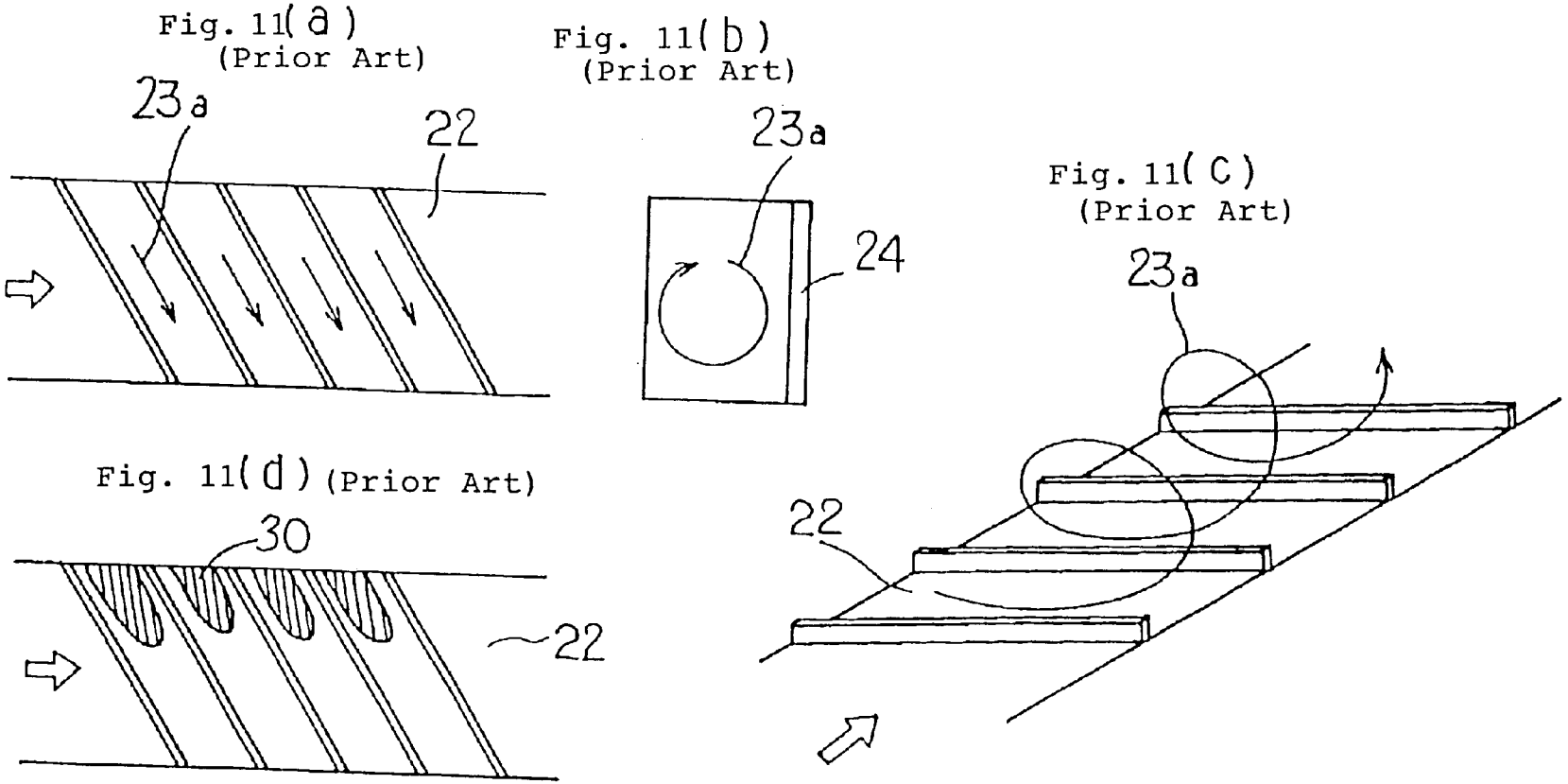
Fig. 11(a) (Prior Art)
Fig. 11(b) (Prior Art)
Fig. 11(c) (Prior Art)
Fig. 11(d) (Prior Art)
FIG. 11 is a schematic explanatory view of a flow pattern and a cooling function thereof of a cooling medium flowing in one of the cooling passages of FIG. 10, wherein FIG. 11(*a*) shows a flow direction of the cooling medium seen on a plan view of the cooling passage, FIG. 11(*b*) shows a flow of the cooling medium seen from one side of FIG. 11(*a*), FIG. 11(*c*) shows the flow of the cooling medium seen perspectively and FIG. 11(*d*) shows a heat transfer rate distribution in the cooling passage.

FIG. 6 is a schematic explanatory view of a flow pattern and a heat transfer rate distribution of the cooling medium in the third embodiment of FIG. 5, wherein FIG. 6(*a*) is a plan view of the flow pattern, FIG. 6(*b*) is aside view thereof, FIG. 6(*c*) is a perspective view and FIG. 6(*d*) is a view showing the heat transfer rate distribution. As shown there, the swirl flow 23*b* is generated by the rib 24 and the high heat transfer rate area 30 is thereby formed, as shown in FIGS. 6(*a*) and (*d*) . This high heat transfer rate area 30 has the same function as that of the prior art shown in FIG. 11.

In addition thereto, due to the existence of the pin 28, there is generated a swirl flow 32 on a downstream side of the pin 28. The swirl flow 32 flows along the inclined rib 24 so that a high heat transfer rate area 31 is formed on the opposing side of the high heat transfer rate area 30, as shown in FIG. 6(*d*). Thus, by selecting the diameter d and the height h of the pin 28 arbitrarily, the heat transfer rate at the high heat transfer rate area 31 can be adjusted.

If the entire width W of the cooling passage 22 is large, the pin 28 may be provided in plural pieces along a longitudinal direction of the rib 24. In this case, the high heat transfer rate area can be enlarged.

In the present embodiment where the pin 28 is provided projectingly, it will be preferable if the pin 28 is provided so as to connect a dorsal side portion and a ventral side portion of the blade, because the pin 28 may function in this case not only for acceleration of cooling but also as a reinforcing element of the blade which is a hollow blade having a thin wall structure.

According to the third embodiment, like in the second embodiment, the high heat transfer rate area is enlarged, thereby the average heat transfer rate can be enhanced.

It is understood that the invention is not limited to the particular construction and arrangement herein illustrated and described, but also embraces such modified forms thereof as come within the scope of the following claims.

What is claimed is:

1. A gas turbine blade comprising:

an inner peripheral side;

an outer peripheral side;

a blade portion having a plurality of cooling passages extending in a turbine radial direction between said outer peripheral side and said inner peripheral side, said plurality of cooling passages including:

a first cooling passage arranged at an upstream position of said blade portion with respect to a turbine main gas flow path at an exterior of said blade portion, said first cooling passage being closed at said outer peripheral side and at said inner peripheral side and having at least one film cooling hole for allowing communication between an interior of said first cooling passage and the main gas flow path;

a second cooling passage arranged downstream of said first cooling passage with respect to the turbine main gas flow path and being separated from said first cooling passage by a partition wall, said second cooling passage being closed at said inner peripheral side and having at least one communication hole in said partition wall for allowing communication between an interior of said second cooling passage and said interior of said first cooling passage; and at least one seal air passage arranged downstream of said second cooling passage with respect to the turbine main gas flow path, each of said at least one seal air passage having a seal air supply hole at said inner peripheral side for allowing communication between an interior of each of said at least one seal air passage and an inner cavity of the turbine adjacent to said inner peripheral side.

2. A gas turbine blade comprising:

a cooling passage for channeling a cooling medium, said cooling passage having a first side, a second side, a center longitudinal axis, and an inner wall; and a plurality of ribs on said inner wall of said cooling passage, said ribs being arranged so as to cross a flow direction of the cooling medium and so as to have a predetermined rib-to-rib pitch, each of said ribs having a first end, a second end, a side face, and is formed such that a height of each of said ribs gradually decreases from a high portion at said first end to a low portion at said second end, said ribs extending from one of said first side and said second side in an alternating manner such that said first end of each rib is located at a position past said center longitudinal axis, each of said ribs being inclined with respect to said center longitudinal axis of said cooling passage such that said first end of each of said ribs contacts said side face of an adjacent rib immediately upstream thereof.

3. A gas turbine blade comprising:

a cooling passage for channeling a cooling medium, said cooling passage having a first side, a second side, a center longitudinal axis, and an inner wall; and a plurality of ribs on said inner wall of said cooling passage, said ribs being arranged so as to cross a flow direction of the cooling medium and so as to have a predetermined rib-to-rib pitch, each of said ribs having an end and a side face, said ribs extending from one of said first side and said second side in an alternating manner such that said end of each rib is located at a position past said center longitudinal axis, each of said ribs being inclined with respect to said center longitudinal axis of said cooling passage such that said end of each of said ribs contacts said side face of an adjacent rib immediately upstream thereof.

4. A gas turbine blade comprising:

a cooling passage for channeling a cooling medium, said cooling passage having an inner wall; and a plurality of ribs on said inner wall of said cooling passage, said ribs being arranged so as to cross a flow direction of the cooling medium and so as to have a predetermined rib-to-rib pitch, wherein at least one of said ribs includes a pin projecting substantially perpendicular to said at least one of said ribs at a predetermined position on a longitudinal axis of said at least one of said ribs.

5. The gas turbine blade of claim 4, wherein each of said ribs includes a pin projecting substantially perpendicular to said at least one of said ribs at a predetermined position on a longitudinal axis of said at least one of said ribs.

6. The gas turbine blade of claim 4, wherein said pin of each of said at least one of said ribs comprises a plurality of pin pieces, said pin pieces being arranged on said at least one of said ribs such that each of said at least one of said ribs has a predetermined pin piece-to-pin piece pitch.

7. The gas turbine blade of claim 6, wherein said cooling passage has a dorsal side inner wall and a ventral side inner wall, each of said pin pieces being arranged in said cooling passage so as to connect said dorsal side inner wall and said ventral side inner wall.

8. The gas turbine blade of claim 4, wherein said cooling passage has a dorsal side inner wall and a ventral side inner wall, said pin of each of said at least one of said ribs being arranged in said cooling passage so as to connect said dorsal side inner wall and said ventral side inner wall.

* * * * *